US007401603B1

(12) United States Patent
Lepley

(10) Patent No.: US 7,401,603 B1
(45) Date of Patent: Jul. 22, 2008

(54) HIGH TENSION CAPACITIVE DISCHARGE IGNITION WITH REINFORCING TRIGGERING PULSES

(75) Inventor: Joseph M. Lepley, Girard, OH (US)

(73) Assignee: Altronic, Inc., Girard, OH (US)

( * ) Notice: Subject to any disclaimer, the term of this patent is extended or adjusted under 35 U.S.C. 154(b) by 30 days.

(21) Appl. No.: 11/702,003

(22) Filed: Feb. 2, 2007

(51) Int. Cl.
*F02P 3/08* (2006.01)

(52) U.S. Cl. ..... 123/605; 123/598; 123/606; 123/620; 315/209 CD

(58) Field of Classification Search ..... 123/598, 123/605, 606, 620, 637; 315/209 T, 209 CD
See application file for complete search history.

(56) References Cited

U.S. PATENT DOCUMENTS 3,906,919 A * 9/1975 Asik et al. ..... 123/598
4,004,561 A 1/1977 Thieme
4,327,701 A * 5/1982 Gerry ..... 123/598
4,479,467 A * 10/1984 Burrows et al. ..... 123/606
5,429,103 A 7/1995 Rich
5,754,011 A 5/1998 Frus et al.
6,662,792 B2 * 12/2003 Dutt et al. ..... 123/598

* cited by examiner

*Primary Examiner*—T. M Argenbright
(74) *Attorney, Agent, or Firm*—The Webb Law Firm

(57) ABSTRACT

A capacitive discharge ignition system in which a controllable switch is positioned between a storage capacitor and the primary winding of an ignition transformer. The switch is controlled to create a train of pulses to the primary winding timed to reinforce the ringing action of the ignition transformer.

16 Claims, 11 Drawing Sheets

HIGH TENSION CAPACITIVE DISCHARGE IGNITION WITH REINFORCING TRIGGERING PULSES

BACKGROUND OF THE INVENTION

1. Field of the Invention

This invention relates to capacitive discharge ignition systems wherein a charge capacitor is switched to deliver energy to the primary of an ignition coil (transformer) in synchronism with the rotation of the engine crank shaft.

2. Description of Related Art

U.S. Pat. No. 4,004,561 entitled "Ignition System" discloses a capacitive discharge ignition system in which multiple capacitors are switched by multiple switches to provide contiguous sequential pulses to the primary of a high tension coil. U.S. Pat. No. 5,429,103 entitled "High Performance Ignition System" discloses charging and discharging pulses from a capacitor to the primary of a high tension coil. The pulses are spaced so the ringing action of the coil has been substantially damped prior to the next pulse. U.S. Pat. No. 5,754,011 entitled "Method and Apparatus for Controllably Generating Sparks in an Ignition System or the Like" discloses discharging multiple capacitors of different sizes to an ignition coil in overlapping, partially overlapping and non-overlapping pulses to generate a desired wave shape in the primary.

SUMMARY OF THE INVENTION

It is an object, according to the present invention, to provide a capacitive discharge ignition system capable of generating a spark discharge between the spark plug electrodes with a higher breakdown voltage capability, greater secondary current, and spark duration much longer than typical for the type of ignition coil in use.

It is a further object, according to the present invention, to be able to adjustably and selectively modify or disable the higher voltage capability, greater secondary current, and extended duration spark to obtain the best possible spark plug life.

When engine operation conditions require higher voltage capability, greater secondary current or spark durations previously unavailable from capacitive discharge ignitions, the modified spark can be enabled. This allows the use of a capacitive spark ignition system for a wide range of possible ignition requirements.

Briefly, according to the present invention, there is provided a capacitive discharge (CD) ignition system for an internal combustion engine. The ignition system comprises a storage capacitor and diode in series therewith, and a power supply connected in series with the storage capacitor and diode. An ignition transformer has primary and secondary windings. The primary winding of the ignition transformer and the storage capacitor are connected in series through a controllable switch. A spark plug is connected in series with the secondary winding of the ignition transformer. The improvement comprises a circuit provided to control the controllable switch in synchronism with the engine such that when the switch is to discharge, a first pulse from the storage capacitor to the primary of the ignition coil. The switch is reopened at a specific time during the damped sinusoidal voltage waveform initiated by the first pulse to avoid doing negative work and then closed to discharge a subsequent pulse to reinforce the ringing action in the ignition secondary circuit. The subsequent pulse is supplied at a specific time or phase of the secondary voltage waveform by the controllable switch and capacitor to reinforce the voltage created by the previous "ON" state of the switch delivering the first pulse. The number of times the second switch is reopened and closed and the ON time period for which the switch remains closed may be controlled to control the coil breakdown voltage capability and/or the duration and amplitude of the extended spark current.

Preferably, the control circuit for the controllable switch causes the switch to be opened and closed a variable number of times during each firing event until a spark breakdown is sensed. Preferably, the controllable switch causes the switch to be opened and closed a variable number of times up to a maximum number during each firing event to limit the highest available breakdown voltage of the coil.

According to one embodiment, the control circuit for the controllable switch causes the switch to be opened and closed a variable number of times until a spark breakdown is sensed and the secondary breakdown voltage required by the engine is estimated by counting the number of reinforcing primary pulses sent before the breakdown event is sensed. Preferably, the control circuit for the controllable switch drives the switch at an adjustable rate so as to improve the resolution of the secondary voltage sensing function.

According to one embodiment, the control circuit drives the switch to establish the time period for which the switch remains closed such that the amplitude of the extended arc current of the spark is controlled. Preferably, the control circuit for the controllable switch causes the pulse train to continue to send additional pulses to drive the secondary current higher until a desired secondary current level is reached.

According to one embodiment, the control circuit for the controllable switch causes the pulse train for the control of the switch to continue to send additional pulses to drive the secondary current higher until a desired maximum secondary current level is reached and then suspends sending pulses until the current falls to a value below a desired minimum secondary current level when pulses are then sent again.

According to another embodiment, the control circuit for the controllable switch causes the pulse train for the control of the switch to continue to send additional pulses to drive the secondary current higher until a desired maximum secondary current level is reached and then suspends sending pulses until the current falls to a value below a desired minimum secondary current level when pulses are then sent again to establish a desired total time of the spark duration.

According to one embodiment, the control circuit for the controllable switch operates in a closed loop manner by measuring the behavior of the circuit parameters, such as secondary voltage, to establish the exact wave shape of the pulse train sent to the controllable switch.

According to an alternate embodiment, the control circuit for the controllable switch operates in an open loop manner by using a stored memory map to establish the exact wave shape of the pulse train sent to the controllable switch.

According to an alternate embodiment, the control circuit for the controllable switches establishes the duration and amplitude of the extended arc current of the spark to be controlled independently of the initial breakdown voltage required to initiate the spark.

According to an alternate embodiment, the control circuit for the controllable switch establishes the secondary power versus time wave shape to produce a spark having a desired energy envelope.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
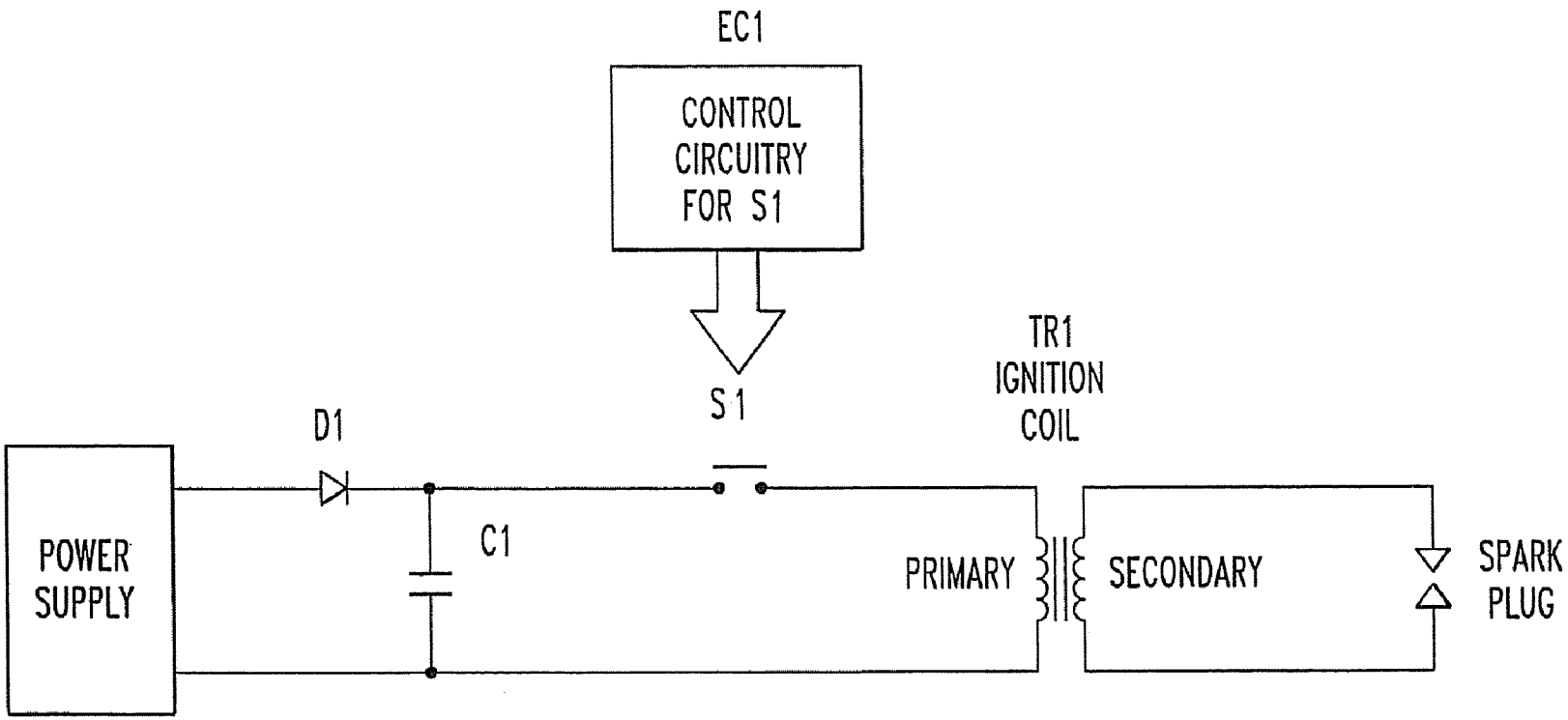
FIG. 1 illustrates the basic circuit of a high tension capacitive discharge ignition system with a control circuit for opening and closing the switch between the storage capacitor and the ignition coil according to one embodiment of the present invention.

Referring now to FIG. 1, there is shown a basic capacitive discharge circuit for a high tension ignition system which comprises a storage capacitor (C1), a diode (D1), and power supply connected in series. An ignition transformer (TR1) has primary and secondary windings. The primary winding is in series with the storage capacitor and a controllable switch (S1). A spark plug is connected in series with the secondary winding of the ignition transformer. An electronic control circuit (EC1) drives the controllable switch.

Figure 2:
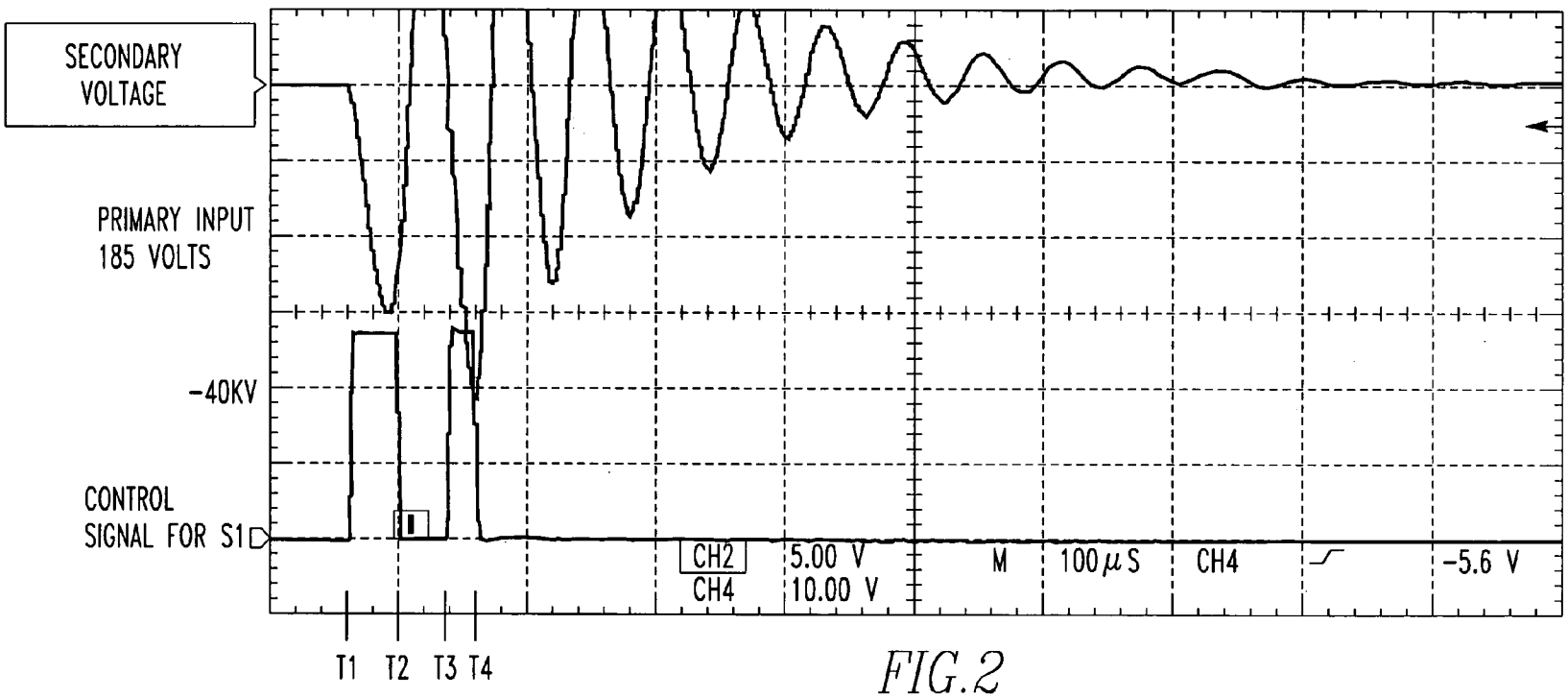
FIG. 2 is an oscilloscope picture showing the open circuit output voltage for an ignition coil driven by a first pulse and a reinforcing pulse according to one embodiment of the present invention.

Referring to FIG. 2, in one embodiment of the present invention, the electronic control circuit is operated in synchronism with the engine and controls the open (conducting) and closed (non-conducting) periods of the switch such that the switch (S1) is initially closed for a period of time (T1) to transfer energy to the ignition coil primary; the switch (S1) is then opened for a second period of time (T2); the switch S1 is again closed for a time (T3); and then switch S1 is opened for a time (T4) and so on creating a pulse train as determined by the control circuit. The switch (S1) is controlled to provide a successive string of control pulses. Each of the individual pulse times has duration and spacing as determined by the control circuit. The pulses are arranged in time to occur when it is possible to reinforce the ringing action of the coil secondary voltage resulting from the previous pulses in order to increase the open circuit breakdown voltage capability of the ignition transformer.

The electronic control circuit may comprise a programmable microcontroller with input ports for sensing one or more positions relative to the rotation of the crank shaft, such as top dead center of the first cylinder, an input for the sensing the current and/or voltage in the secondary circuit of at least one ignition transformer, and outputs for opening and closing one or more controllable switches.

Figure 3:
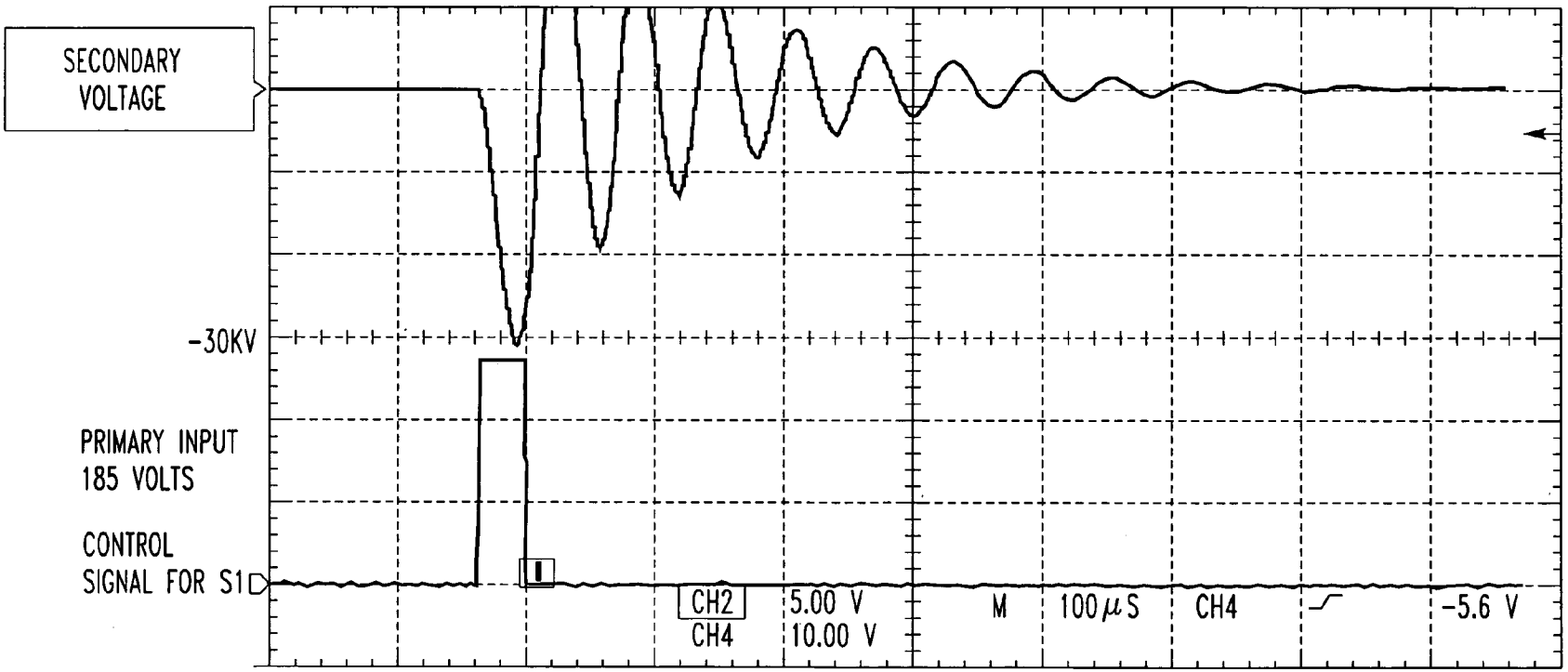
FIGS. 3, 4, and 5 are oscilloscope pictures showing the open circuit output voltage for an ignition coil driven according to prior art techniques.

By way of comparison, FIG. 3 illustrates an oscilloscope picture showing the typical open circuit output voltage for an ignition coil driven in the standard manner. For a switch S1, "ON" time of about 40 microseconds, this coil produces an output of −30,000 volts at the spark plug. The output voltage for this coil will not increase significantly from this value regardless of the "ON" duration time for switch S1, even though the energy sent to the coil increases in direct proportion to the "ON" time of S1.

As shown in FIG. 2, the output voltage increased approximately 30% as compared with a coil driven in the standard manner. The increased output voltage is about 10,000 volts higher than could be achieved with the traditional drive approach at any of the input energies tested. The primary was supplied by a capacitor charged to 185 volts in all cases.

Figure 4:
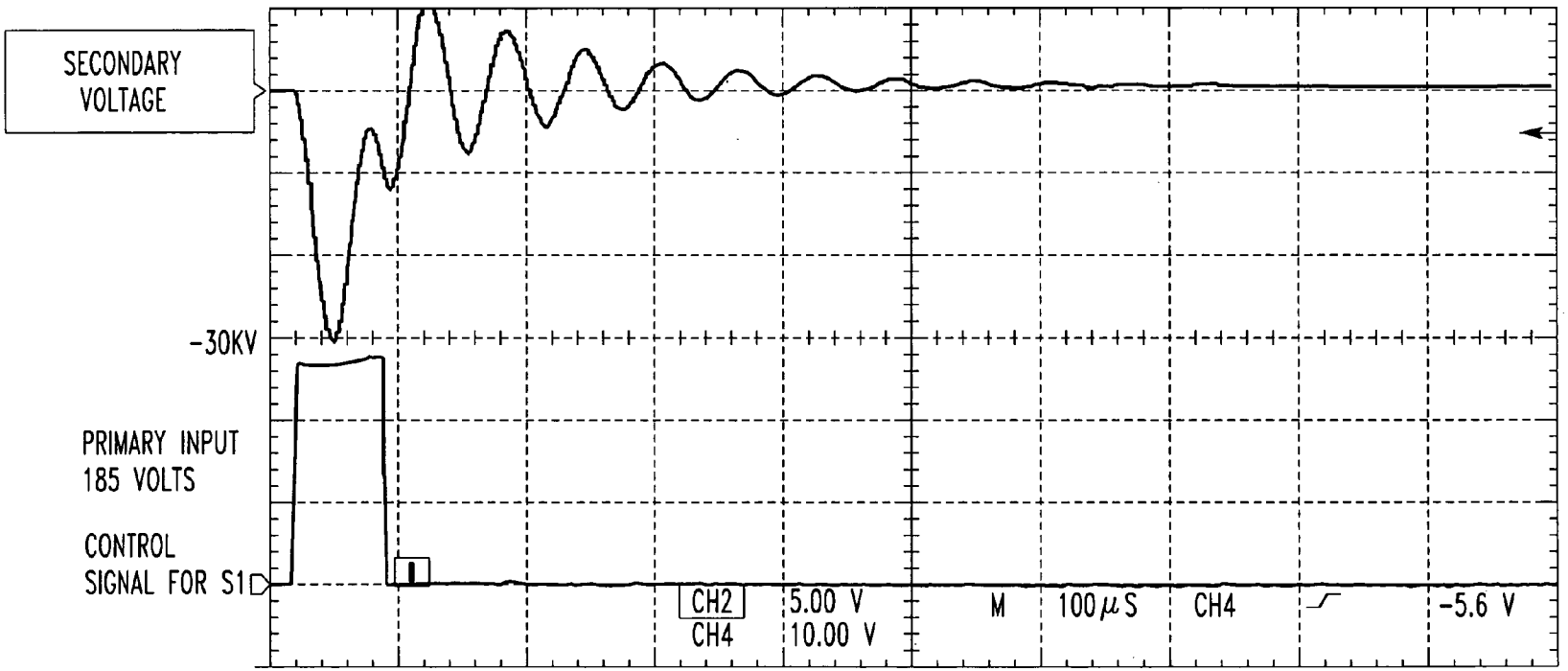

By way of further comparison, FIG. 4 illustrates an oscilloscope display showing the typical open circuit output voltage for an ignition coil driven in the standard manner with the "ON" time for switch S1 increased to about 80 microseconds to increase the input energy delivered to the coil. Note that there is no significant increase in the output voltage of the ignition coil; it is still about 30,000 volts. Also note for later reference the "hump" in the secondary voltage waveform.

Figure 5:
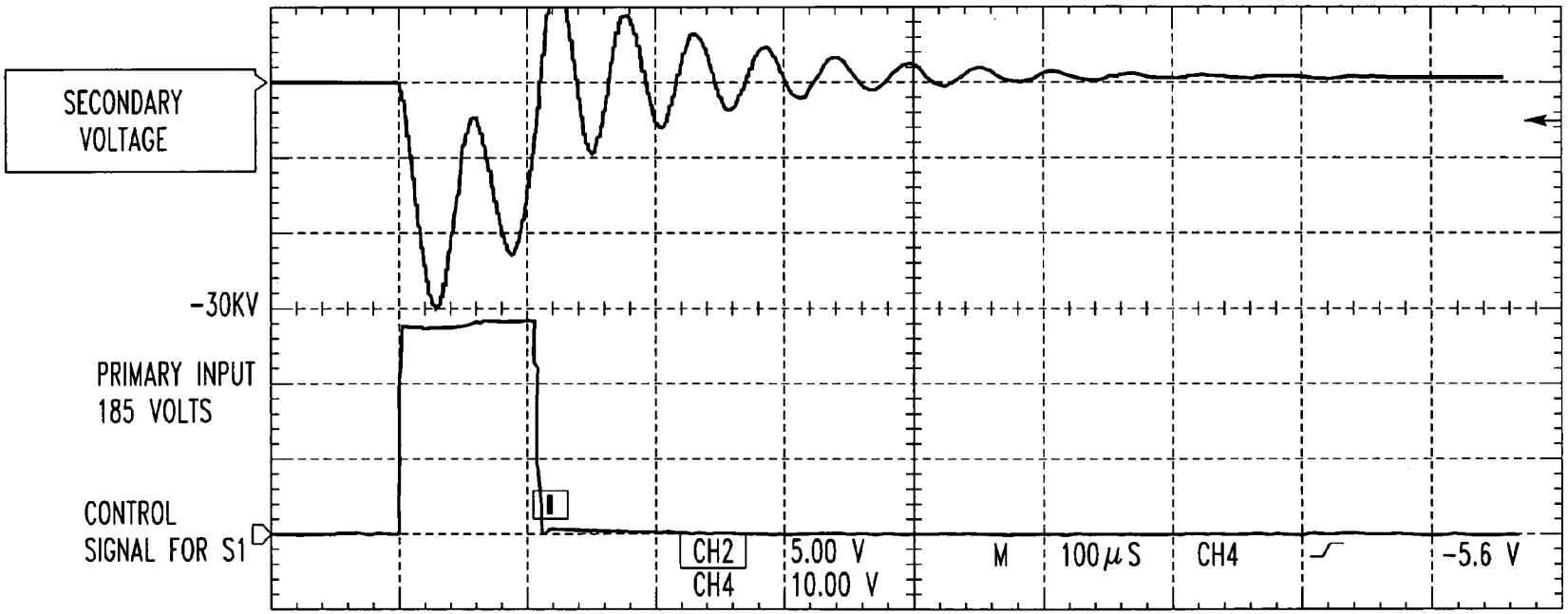

By way of further comparison, FIG. 5 illustrates an oscilloscope display showing the typical open circuit output voltage for an ignition coil driven in the standard manner with the "ON" time for switch S1 increased to about 100 microseconds (250% increase from FIG. 3) with no significant increase in the output voltage of the ignition coil. The maximum open circuit output voltage is about −30,000 volts. Also note the increase of the amplitude of the second "hump" in the secondary voltage waveform. Conventional drive of the coil based upon the currently accepted technique results in a maximum coil output voltage for a given supply voltage regardless of input power consumed as controlled by the switch S1 "ON" time.

It is generally accepted that the maximum output voltage of the coil is limited by the primary voltage and the turns ratio of the primary to the secondary winding. It will be shown that this is not the case.

By changing the control signal for S1 to a pulse train of two pulses at a specific time as shown in FIG. 2, instead of a single pulse, the output voltage of the coil is driven to a higher voltage than that shown in FIG. 3, 4 or 5 (−40,000 volts versus −30,000 volts). Even though the cumulative "ON" time of switch S1 as shown in FIG. 3 is only slightly greater (about 50 microseconds) than in FIG. 2 and far less than the "ON" time for S1 shown in FIG. 4 (about 80 microseconds), the coil output voltage is higher. The power consumed on the primary side is, however, less in the same proportion as the "ON" time of switch S1.

Based upon the observation of the waveform of FIG. 4, the trailing part of the drive provided by switch S1 is wasted since no increase in voltage occurs during or after its addition. In fact, the first positive ring of the secondary waveform is eliminated and the first negative ring is reduced in amplitude. In effect, the extended pulse after the first negative transition is doing negative work.

Figure 6:
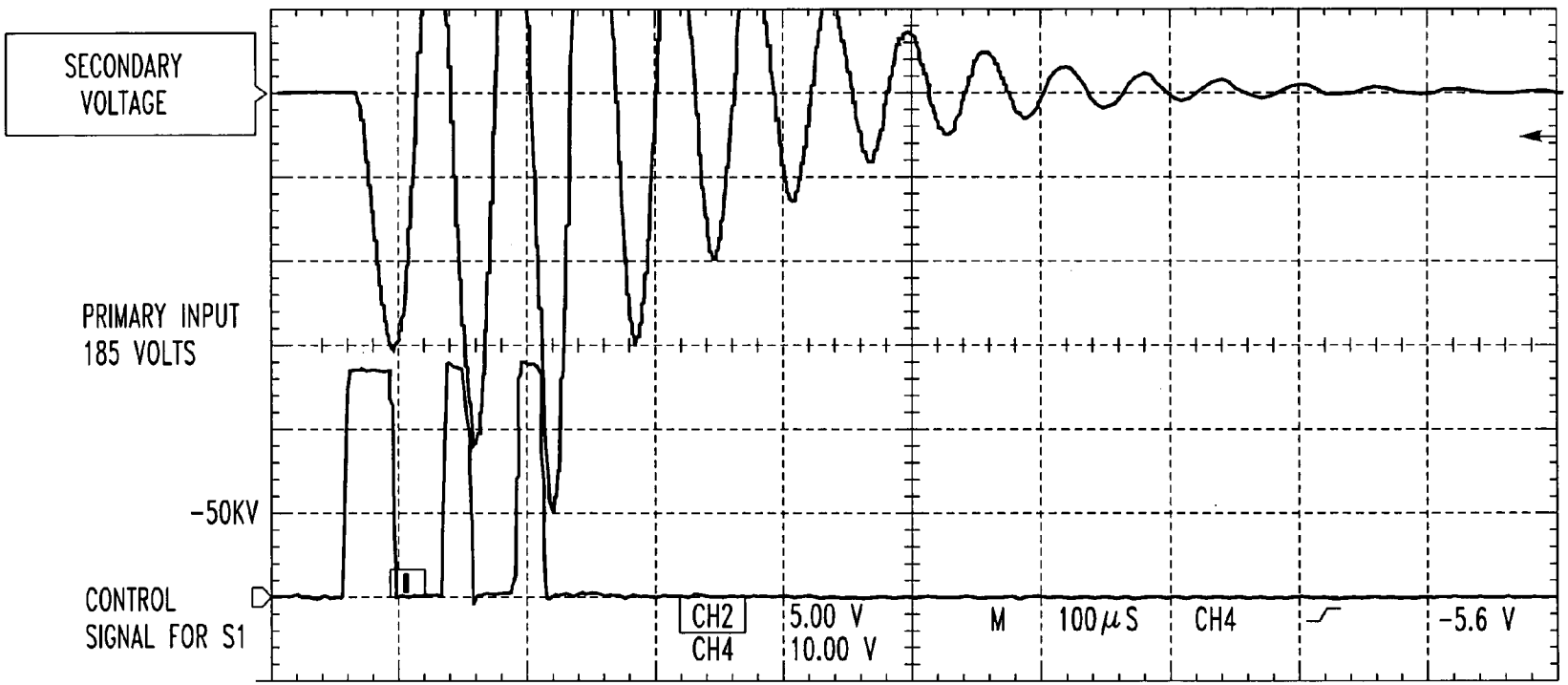

Referring to FIG. 6, changing the control signal for S1 to a pulse train of three pulses according to the present invention instead of a single pulse, the output voltage of the coil is driven to about 48,000 volts even though the cumulative "ON" time of switch S1 is only about 70 microseconds. The input energy is increased about 75% and the output voltage increased about 60% as compared with the standard drive method. The increased output voltage is about 18,000 volts higher than could be achieved with the traditional drive approach at any input energy with the primary supply of 185 volts. Also, the input power consumed is still far less than in the technique shown in FIG. 5.

Figure 7:
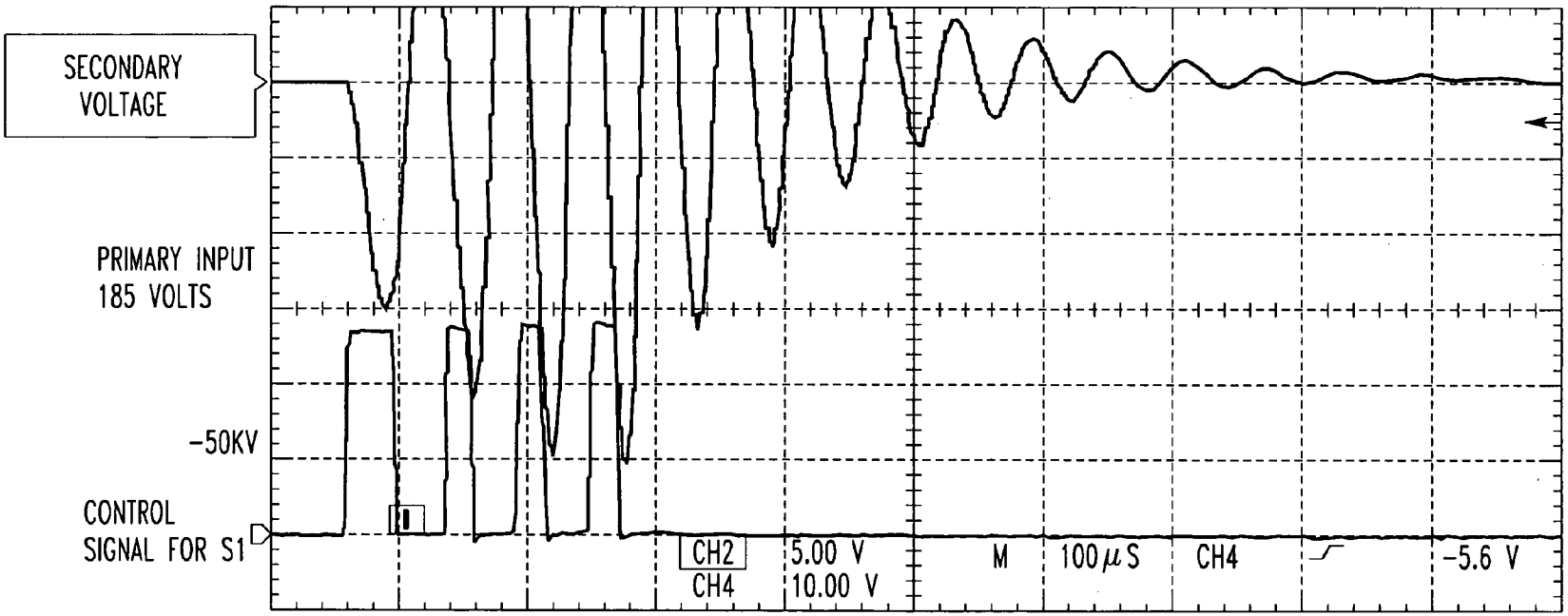
FIGS. 7 and 8 are oscilloscope pictures showing the open circuit output voltage for an ignition coil driven by a first pulse and multiple reinforcing pulses according to additional embodiments of the present invention.
Figure 8:
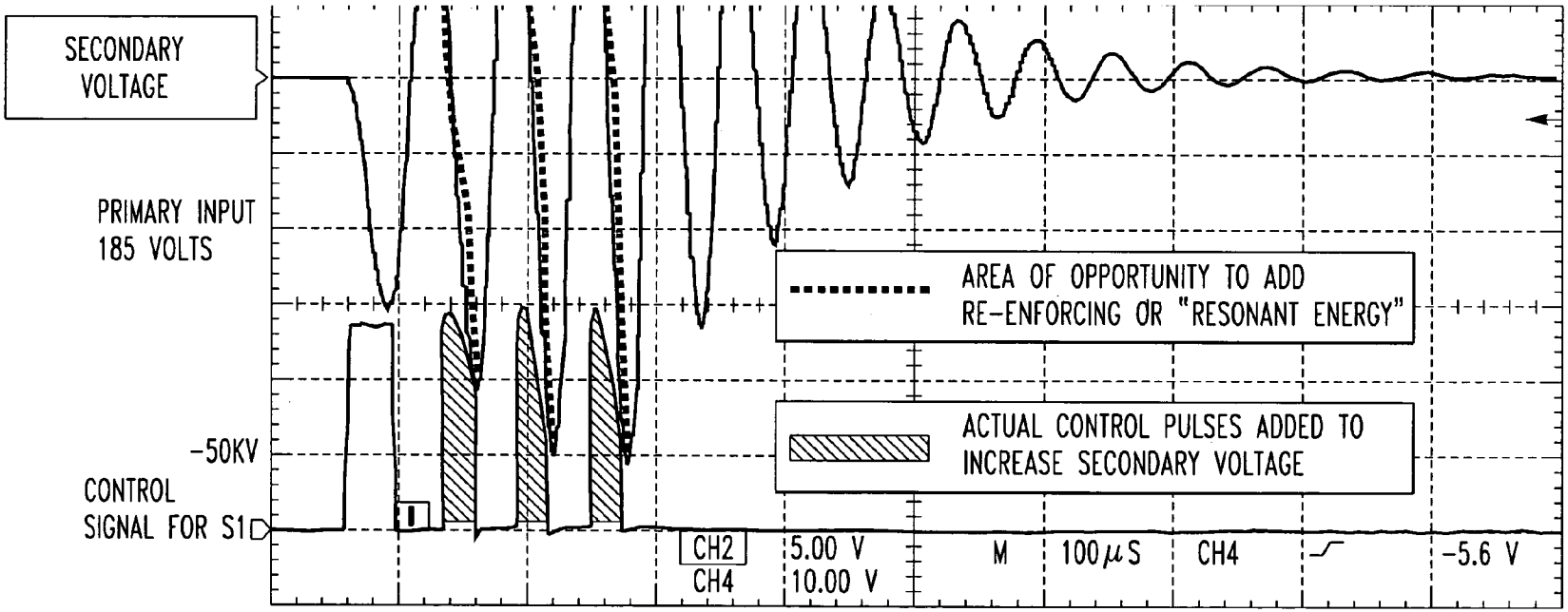

Referring to FIG. 7, additional energy added to the coil primary at a certain time or phase of the secondary waveform increases the output voltage of the coil. As shown in FIG. 5, the same amount of energy (S1 "ON" time 100 microseconds) added as a single pulse without regard to the timing or phase of the secondary waveform does not increase the coil output voltage at all. The total ON time of switch S1 in FIG. 7 is equal to the total ON time of S1 in FIG. 5, but the maximum output voltage of the coil is significantly higher (at least −51,000 volts versus −30,000 volts). At this point, the input power consumed is equal to the case of FIG. 5.

Referring again to FIG. 7, the drive energy added to the coil primary at the time or phase angle of the secondary waveform as shown above greatly increases the output voltage capability of the coil. This increased voltage is a result of driving the coil with a pulsed signal whereby each pulse reinforces the secondary effects of the previous pulse. This behavior is similar to that of an RLC circuit in a resonant condition, although the actual requirements for a truly resonant circuit on the coil secondary are not being fulfilled.

FIG. 7 establishes that it is possible to drive a given ignition coil with a series of timed pulses which will cause the open circuit voltage capability to increase as a result of each pulse. This allows a coil which, by its design limits and physical construction (turns ratio), has previously been unable to achieve the voltage required for secondary breakdown of the spark to occur, and to continue to operate even though much higher secondary voltages may now be required by the engine. Possible causes of the higher engine voltage demand could include worn spark plugs, poor fuel quality, changed air/fuel ratio, higher engine load and increased cylinder pressure at the time of the ignition firing.

An ignition diagnostic can be made by sensing the flow of secondary current and counting the number of drive pulses sent by S1. Since each pulse increases the output voltage, the actual required breakdown voltage can be positively identified by counting the drive pulses required to cause a secondary current to flow. Additionally, by always sending at least one more pulse after the one causing the secondary voltage breakdown, a safety margin on operating voltage and energy can be readily maintained. Since the number of pulses required to cause the secondary breakdown is proportional to the breakdown voltage and the spark plug voltage requirement is an indicator of the condition of the spark plugs, the need for plug replacement can be readily determined.

Instead of sensing secondary current, the occurrence of the spark breakdown could also be determined by a measurement of the secondary voltage collapsing to a lower level which could be sensed a number of ways, for example, by capacitive or transformer coupling to a low voltage circuit. While the breakdown voltage can be determined with only limited resolution (about 10,000 volts) by counting pulses in the example of FIG. 2, a series of smaller drive pulses to S1 can be used for finer resolution of this voltage.

An additional independent refinement for the determination of the secondary breakdown voltage of the coil can also be made since the time delay of the breakdown after the onset of each of the drive pulses is also proportional to the actual voltage achieved up to that moment. For example, the leading edge of the second pulse plus 7.5 microseconds of delay prior to the breakdown is −35,000 volts as shown in FIG. 7.

In a circuit arrangement of the type shown in FIG. 1, it is also possible to determine the breakdown voltage by measuring the drop in the storage capacitor voltage that has occurred as a result of the cumulative primary drive pulses draining its energy prior to the secondary breakdown being achieved. The larger the drop in voltage of the storage capacitor the greater the voltage demand.

Figure 9:
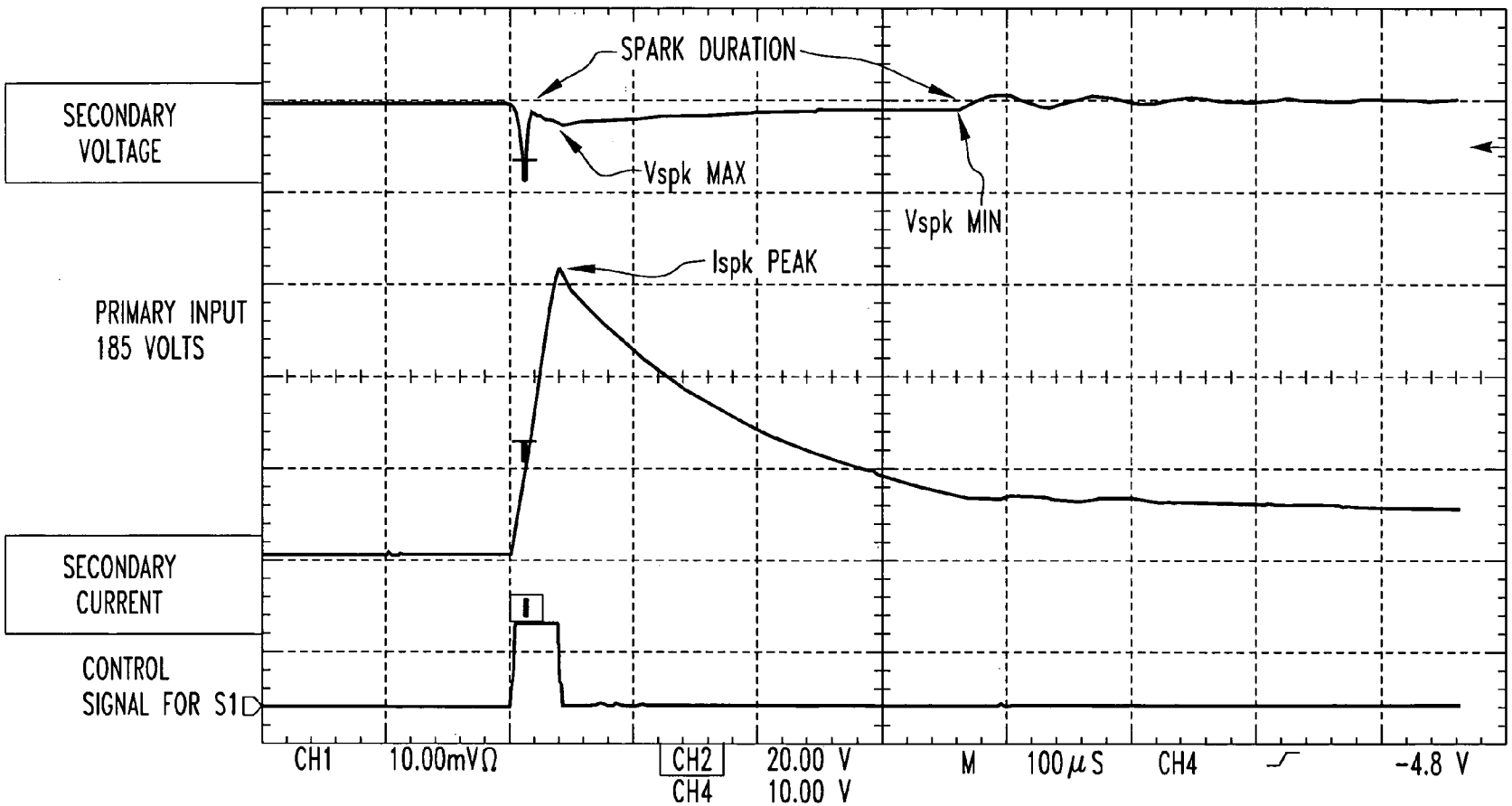
FIG. 9 is an oscilloscope picture showing the secondary current, secondary voltage and traditional control signal for the controlled switch.

Referring to FIG. 9, the secondary current which results from a traditional control signal to switch S1 has a waveform shape which is roughly equivalent to a triangle. The power (Watts) supplied by the coil to the load is equal to the secondary current multiplied by the secondary voltage during the time that the current is flowing in the spark gap. The energy (Joules) delivered to the spark gap is the integral with respect to time of the power waveform. A formula which can be used to estimate the spark energy in Joules is:

$$Espk=((\tfrac{1}{2}(Vspk\mathrm{Max}-Vspk\mathrm{Min}))+Vspk\mathrm{Min})\times(\tfrac{1}{2}Ispk\ \mathrm{Peak})\times(\mathrm{Spark\ duration})\ \text{where:}$$

Espk is in Joules, Vspk is in Volts, Ispk is in Amps and Spark duration is in Seconds.

Figure 10:
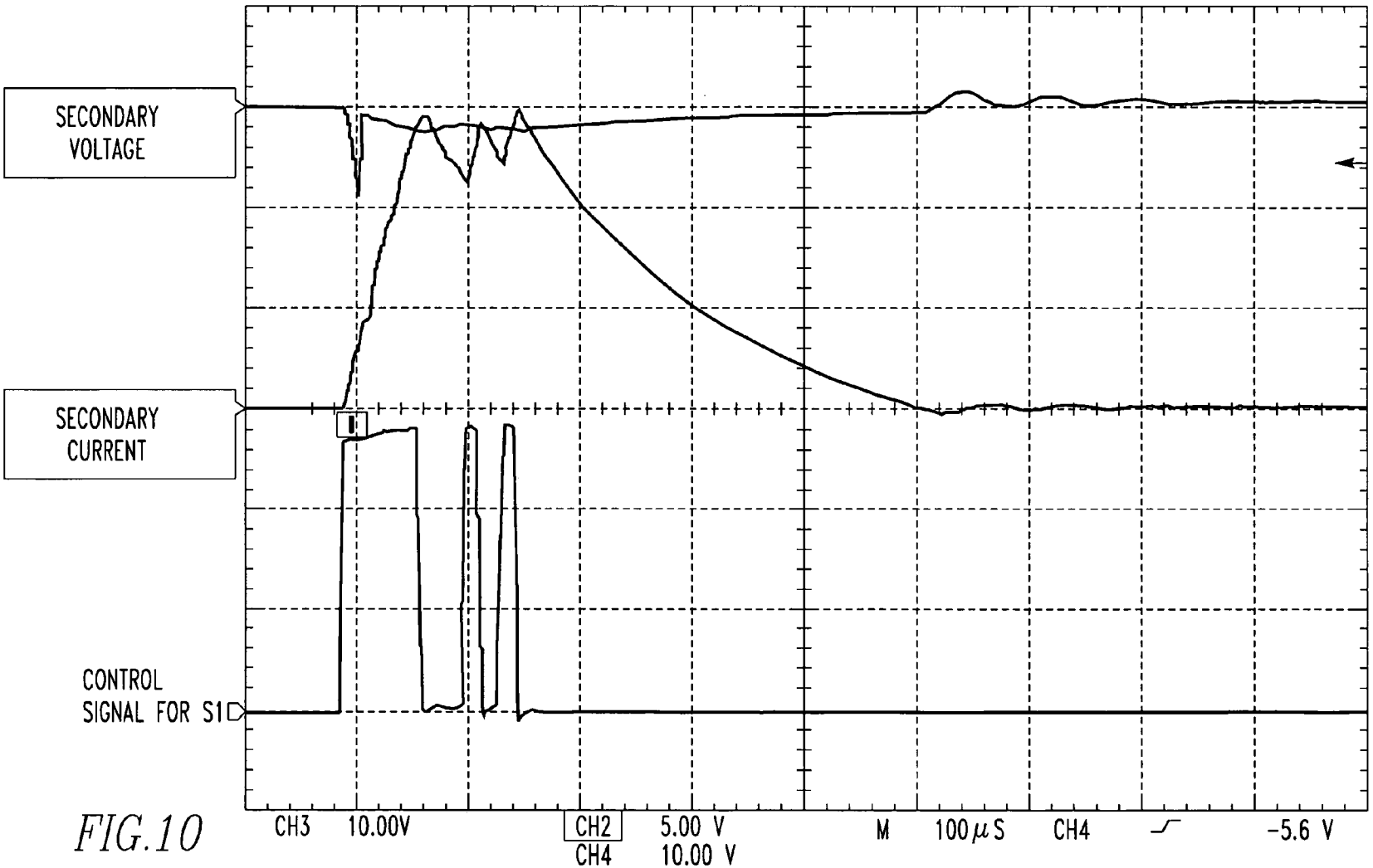
FIGS. 10 and 11 are oscilloscope pictures showing the secondary current, secondary voltage and control signals according to alternate embodiments of the present invention.

Referring to FIG. 10, multiple control pulses to switch S1 can be used to increase energy multiple times. What can also be seen above is that the timing of the S1 control pulses can be used to control the shape of the secondary current waveform versus time. The shape of the VI integral with respect to time is the shape of the "energy envelope" of the spark waveform. The energy envelopes of the various spark waveforms can be used to create a reference framework to correlate the actual energy transfer process of the various sparks to the mixture between the electrodes. It is important to note that the concept of the energy envelope allows for the measurement and control of both the magnitude and timing of the energy transfer to the mixture.

Figure 11:
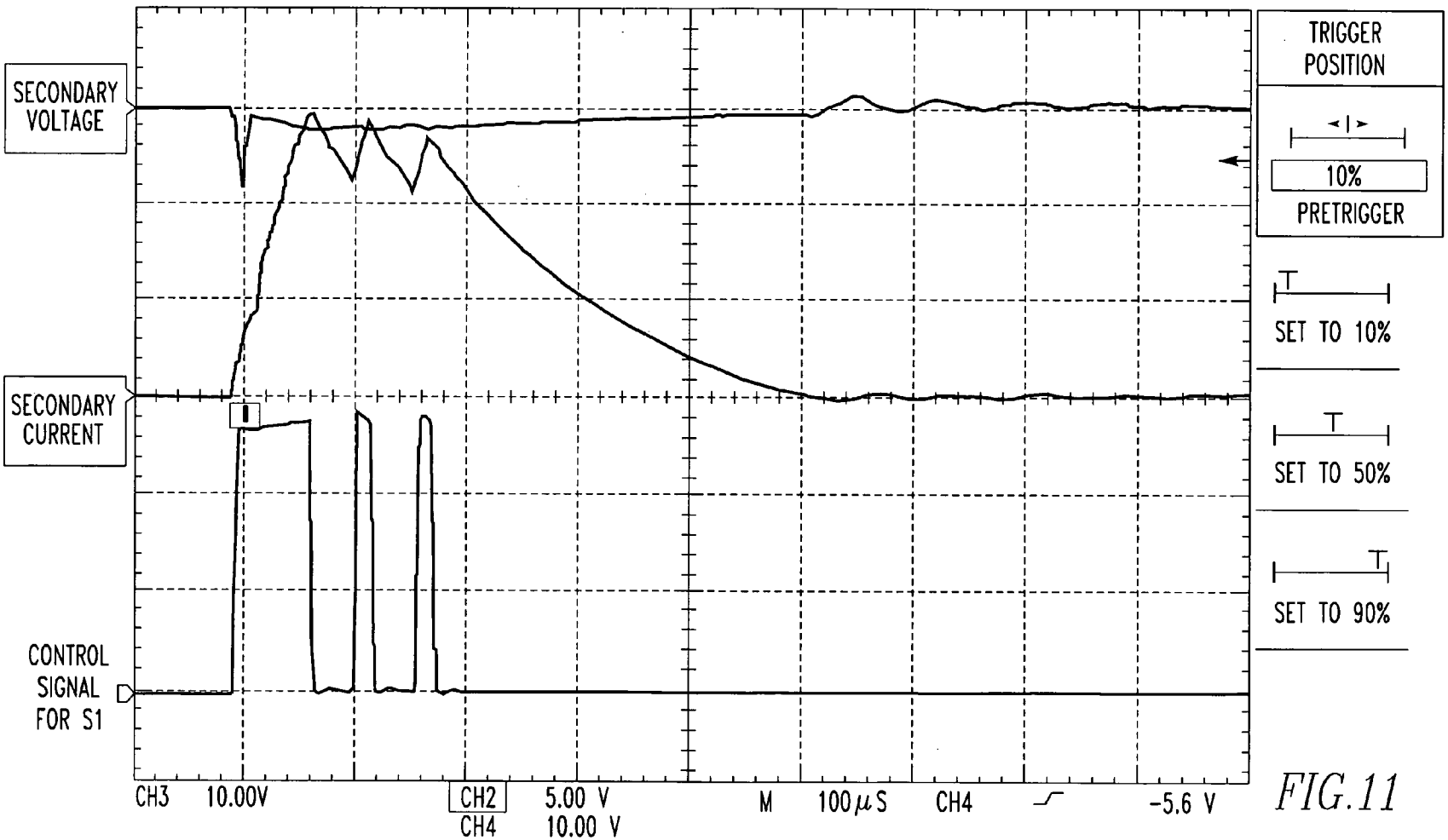

Referring to FIG. 11, the control of the secondary current waveform by the pulsing of switch S1 is time critical and very small changes in the shape of the "energy envelope" delivered to the spark gap can be easily made.

Since the actual energy envelope is the integral of the power (the product of the secondary voltage and current waveforms) and since the secondary voltage waveform remains fairly constant over the time period of interest, it is possible to say that the shape of the energy envelope is directly related to the shape of the secondary current wave form with respect to time.

While the applicant does not wish to be bound by any particular technical theory of operation, it is apparent that even though no discrete capacitor exists in the secondary circuit of the ignition coil, the parasitic distributed capacitance of the coil winding, spark plug lead wire and spark plug can act as a capacitor for temporary energy storage during the time between pulses prior to breakdown. This "coil" is being externally driven to a near resonant condition by a technique referred to as forced resonance. In forced resonance, the forcing function's frequency is selected to be close to the natural frequency of the coil so that it will try to resonate. The forcing function adds primary drive energy at just the right moment during the secondary ring down cycle so that the secondary voltage change is reinforced. This makes the voltage amplitude of the coil secondary winding grow larger and larger. While tuned circuits have previously been proposed for use in ignition systems, these systems have all relied upon carefully selected components connected in a critical manner including a discrete capacitor. The approach used in this system is capable of working even though the secondary circuit parameters may vary widely.

In the present invention, an electronic means is used to drive each coil in a manner as to cause the increasing voltage either based upon measured behavior of the secondary (closed loop control) or based upon the use of an appropriate predefined drive pattern of primary pulses stored in a memory device (open loop control).

Having thus described my invention with the detail and particularity required by the Patent Laws, what is desired protected by Letters Patent is set forth in the following claims.

The invention claimed is:

1. In a capacitive discharge ignition system for an internal combustion engine comprising: a storage capacitor; a power supply connected in series with the storage capacitor; an ignition transformer having primary and secondary windings; and a controllable switch; the primary winding of the ignition transformer and the storage capacitor being connected in series through the controllable switch; a spark plug connected in series with the secondary winding of the ignition transformer; the improvement comprising an electronic control circuit for driving the controllable switch which is operating in synchronism with the engine such that the switch is initially closed for a period of time to transfer energy to the ignition coil primary, that after this time, the switch is then opened for a second period of time and then the switch is again closed creating a pulse train, such that the switch is controlled by a successive string of control pulses to the switch, each of the individual pulse times having a duration and spacing as determined by the control circuit, these pulses being arranged in time to occur when it is possible to reinforce the ringing action of the ignition transformer secondary voltage resulting from the previous primary pulses, such that the open circuit breakdown voltage capability of the ignition transformer is increased.

2. A device according to claim 1, wherein the control circuit for the controllable switch causes the switch to be opened and closed a variable number of times during each firing event until a spark breakdown is sensed.

3. A device according to claim 1, wherein the control circuit for the controllable switch causes the switch to be opened and closed a variable number of times up to a maximum number during each firing event to limit the highest available breakdown voltage of the coil.

4. A device according to claim 1, wherein the control circuit for the controllable switch causes the switch to be opened and closed a variable number of times during each firing event until a spark breakdown is sensed and the secondary breakdown voltage required by the engine is estimated by counting the number of reinforcing primary pulses sent before the breakdown event is sensed.

5. A device according to claim 1, wherein the control circuit for the controllable switch drives the switch at an adjustable rate during the reinforcing time periods available so as to improve the resolution of the voltage sensing function.

6. A device according to claims 1, 2, 3, 4 or 5, wherein the control circuit for the controllable switch operates in a closed loop manner by measuring the behavior of the circuit parameters to determine the exact wave shape of the pulse train sent to the controllable switch.

7. A device according to claims 1, 2, 3, 4 or 5, wherein the control circuit for the controllable switch (S1) operates in an open loop manner by using a stored memory map to determine the exact wave shape of the pulse train sent to the controllable switch.

8. In a capacitive discharge ignition system for an internal combustion engine comprising: a storage capacitor; a power supply connected in series with the storage capacitor; an ignition transformer having primary and secondary windings; and a controllable switch; the primary winding of the ignition transformer and the storage capacitor being connected in series through the controllable switch; a spark plug connected in series with the secondary winding of the ignition transformer; the improvement comprising an electronic control circuit for driving the controllable switch which is operating in synchronism with the engine such that the switch is initially closed for a period of time to transfer energy to the ignition coil primary, that after this time, the switch is then opened for a second period of time and then the switch is again closed creating a pulse train, such that the switch is controlled by a successive string of control pulses to the switch, each of the individual pulse times having a duration and spacing as determined by the control circuit, these pulses being arranged in time to occur when it is possible to reinforce the ringing action of the ignition transformer secondary voltage resulting from the previous primary pulses, such that the secondary circuit current capability of the ignition transformer is increased.

9. A device according to claim 8, wherein the control circuit drives the switch to establish the time period for which the switch remains closed such that the amplitude of the extended arc current of the spark is controlled.

10. A device according to claim 8, wherein the control circuit for the controllable switch causes the pulse train to continue to send additional pulses to drive the secondary current higher until a desired secondary current level is reached.

11. A device according to claim 8, wherein the control circuit for the controllable switch causes the pulse train for the control of the switch to continue to send additional pulses to drive the secondary current higher until a desired maximum secondary current level is reached and then suspend sending pulses until the current falls to a value below a desired minimum secondary current level when pulses are then sent again.

12. A device according to claim 8, wherein the control circuit for the controllable switch causes the pulse train for the control of the switch to continue to send additional pulses to drive the secondary current higher until a desired maximum secondary current level is reached and then suspend sending pulses until the current falls to a value below a desired minimum secondary current level when pulses are then sent again, for a desired total time of the spark duration.

13. A device according to claims 8, 9, 10, 11 or 12, wherein the control circuit for the controllable switch operates in a closed loop manner by measuring the behavior of the circuit parameters to determine the exact wave shape of the pulse train sent to the controllable switch.

14. A device according to claims 8, 9, 10 or 11, wherein the control circuit (EC1) for the controllable switch operates in an open loop manner by using a stored memory map to determine the exact wave shape of the pulse train sent to controllable switch.

15. A device according to claims 8, 9, 10 or 11, wherein the control circuit for the controllable switches enables the duration and amplitude of the extended arc current of the spark to be controlled independently of the initial breakdown voltage required to initiate the spark.

16. A device according to claim 12, wherein the control circuit for the controllable switch enables the secondary power versus time wave shape to be controlled to produce a spark having a desired energy envelope.

* * * * *